US005880068A

United States Patent [19]

Gamble et al.

[11] Patent Number: 5,880,068

[45] Date of Patent: Mar. 9, 1999

[54] HIGH-TEMPERATURE SUPERCONDUCTOR LEAD

[75] Inventors: Bruce B. Gamble, Wellesley; Anthony J. Rodenbush, Marlborough; Gregory L. Snitchler, Shrewsbury; Roman J. Jedras, Medford, all of Mass.

[73] Assignee: American Superconductor, Inc., Westborough, Mass.

[21] Appl. No.: 730,870

[22] Filed: Oct. 18, 1996

[51] Int. Cl.[6] ..... H01B 12/00

[52] U.S. Cl. ..... 505/220; 505/230; 174/15.4; 174/15.5; 174/125.1; 335/216

[58] Field of Search ..... 505/230, 220; 174/15.4, 15.5, 125.1; 335/216

[56] References Cited

U.S. PATENT DOCUMENTS

| | | | |
|---|---|---|---|
| 5,296,456 | 3/1994 | Shiga et al. | 505/1 |
| 5,302,928 | 4/1994 | Laskaris et al. | 335/216 |
| 5,384,307 | 1/1995 | Lay | 505/430 |
| 5,396,206 | 3/1995 | Herd et al. | 505/163 |
| 5,426,094 | 6/1995 | Hull et al. | 174/125.1 |
| 5,552,211 | 9/1996 | Ackerman et al. | 428/209 |
| 5,623,240 | 4/1997 | Sakuraba et al. | 335/216 |

FOREIGN PATENT DOCUMENTS

| | | | |
|---|---|---|---|
| 0 627 773 A1 | 12/1994 | European Pat. Off. | 39/14 |
| 0 650 205 A1 | 4/1995 | European Pat. Off. | 39/14 |
| 0 650 206 A1 | 4/1995 | European Pat. Off. | 39/14 |

OTHER PUBLICATIONS

Kato et al., "Development of Low Heat Leak High–Tc Superconducting Current Lead", Submitted to the Proceedings of ISS '94. No page number!.

Masuda et al., "Implementation of 2000A Class High–Tc Current Leads for the Superconducting Compact SR Ring HIJI–III". No publication data!.

*Primary Examiner*—Roy V. King
*Attorney, Agent, or Firm*—Fish & Richardson P.C.

[57] ABSTRACT

The invention relates to a high-temperature superconductor lead element including a plurality of lengths of high-temperature superconductor electrically connected in a non-collinear configuration, for example, next to and parallel with each other, to increase the thermal length of the lead element. A proximal end of a first of the lengths is configured for thermal connection to a warm thermal element and a distal end of a last of the lengths is configured for thermal connection to a cold thermal element. Each length of high-temperature superconductor includes a high-temperature superconductor plate having an electrically insulative support and a plurality of high-temperature superconductor tapes mounted, in a linear array, on the support. A plurality of high-temperature superconductor plates are arranged with their longitudinal axis parallel to form a cylindrical lead with "bad" self-fields in each plate being substantially cancelled by self-fields in neighboring plates.

21 Claims, 7 Drawing Sheets

HIGH-TEMPERATURE SUPERCONDUCTOR LEAD

BACKGROUND OF THE INVENTION

The present invention relates to high-temperature superconductor leads, and more particularly to high-temperature superconductor leads for carrying current to a superconductor magnet.

Resistance heating produced by traditional copper leads when passing high currents creates a significant amount of heat leak into cryocooled superconductor magnet systems. Additional refrigeration is required to overcome the heat leaking into the system to maintain the superconductor at a desired cryogenic temperature.

Bulk superconductor leads in the form of pure castings of superconducting ceramic, generally in the form of rods or tubes with metallic end caps, have been used to supply power from non-superconductor leads to superconducting magnets. These bulk leads are difficult to handle because the pure ceramic is brittle at cryogenic temperatures. There is also significant resistive heat associated with the contact between the bulk material and the metallic end caps resulting in heat leak into the cryocooled superconductor magnet system.

SUMMARY OF THE INVENTION

The invention relates to a high-temperature superconductor lead element including two lengths of high-temperature superconductor. A proximal end of the first length is configured for thermal connection to a warm thermal element and a distal end of the second length is configured for thermal connection to a cold thermal element. A proximal end of the second length is electrically connected to a distal end of the first length with the second length of high-temperature superconductor being non-collinear with the first length of high-temperature superconductor to increase the thermal length of the lead element In particular embodiments of the invention, the second length is positioned next to and parallel with the first length, with the first length proximal end opposing the second length distal end and the first length distal end opposing the second length proximal end. The "bad" self-fields of the first length oppose the "bad" self-fields of the second length, and the "good" self-fields of the first length add to the "good" self-fields of the second length.

A third length of high-temperature superconductor is positioned between the first and second lengths with a first end electrically connected to the distal end of the first length and a second end electrically connected to the proximal end of the first length, such that the first and second lengths are electrically connected through the third length. The third length is non-collinear with the first and second lengths.

The third length is positioned next to and parallel with the first length and the second length is positioned next to and parallel with the third length. The first length proximal end opposes the third length second end, the first length distal end opposing the third length first end, the second length proximal end opposing the third length second end, and the second length distal end opposing the third length first end. The "bad" self-fields of the first and second lengths oppose the "bad" self-fields of the third length.

Each length of high-temperature superconductor includes a high-temperature superconductor plate having an electrically insulative support, and a plurality of high-temperature superconductor tapes mounted, in a linear array, on the support. The superconductor tapes are arranged in a plurality of stacks of one or more tapes per stack, with the first length having more tapes per stack than the second length and the third length having more tapes per stack than the second length and less tapes per stack than the first length.

In particular aspects of the invention, the plate support includes an elongated, substantially flat surface to which the tapes are mounted. A first electrically conductive connector is mounted at one end of the support and a second electrically conductive connector is mounted at the opposite end of the support; each of the superconductive tapes is electrically connected to the connectors.

According to another aspect of the invention, a high-temperature superconductor lead element includes a plurality of lengths of high-temperature superconductor electrically connected in a non-collinear configuration such as a "zig-zag". The lengths include a high-temperature superconductor tape, a cross-sectional area of the tape in each length remaining the same, or decreasing, from a first length to a last length of the lead, with the last length having a smaller cross-sectional area than the first length.

According to another aspect of the invention, a high-temperature superconductor lead includes a plurality of high-temperature superconductor plates arranged with their longitudinal axis parallel to form a cylinder. The plates are arranged such that "bad" self-fields, i.e. perpendicular to the broad face of the lead, are substantially cancelled.

In one illustrated embodiment, a dual high-temperature superconductor lead includes two high-temperature superconductor plates and an insulating sheet placed between the plates.

In a further embodiment, a high-temperature superconductor lead element includes a high-temperature superconductor having a first end with an end piece configured for thermal connection to a warm thermal element, and a second end with an end piece configured for thermal connection to a cold thermal element. The high-temperature superconductor is configured to take a non-direct route from the first end piece to the second end piece.

According to another aspect of the invention, a method of increasing the thermal length of a high-temperature superconductor lead relative to the spacing between a warm end connector and a cold end connector in a cryogenic containment vessel includes providing a high temperature superconductor having a length greater than the spacing, and connecting a first end of the high-temperature superconductor to the warm end and a second end of the high-temperature superconductor to the cold end.

Advantages of the invention include increasing the thermal length of the lead element, which decreases the heat leak from the lead element, thus decreasing the cooling requirements of the cryogenic system. The number of plates and the number of tapes per plate in a lead element, as well as the number of lead elements in a lead, can be optimized for the current requirements of the magnet. The plates and lead elements can be arranged to minimize "bad" self-fields.

BRIEF DESCRIPTION OF THE DRAWINGS

Other objects, features and advantages of the invention will be apparent from the following description taken together with the drawings in which.

DESCRIPTION OF THE PREFERRED EMBODIMENT

Figure 1:
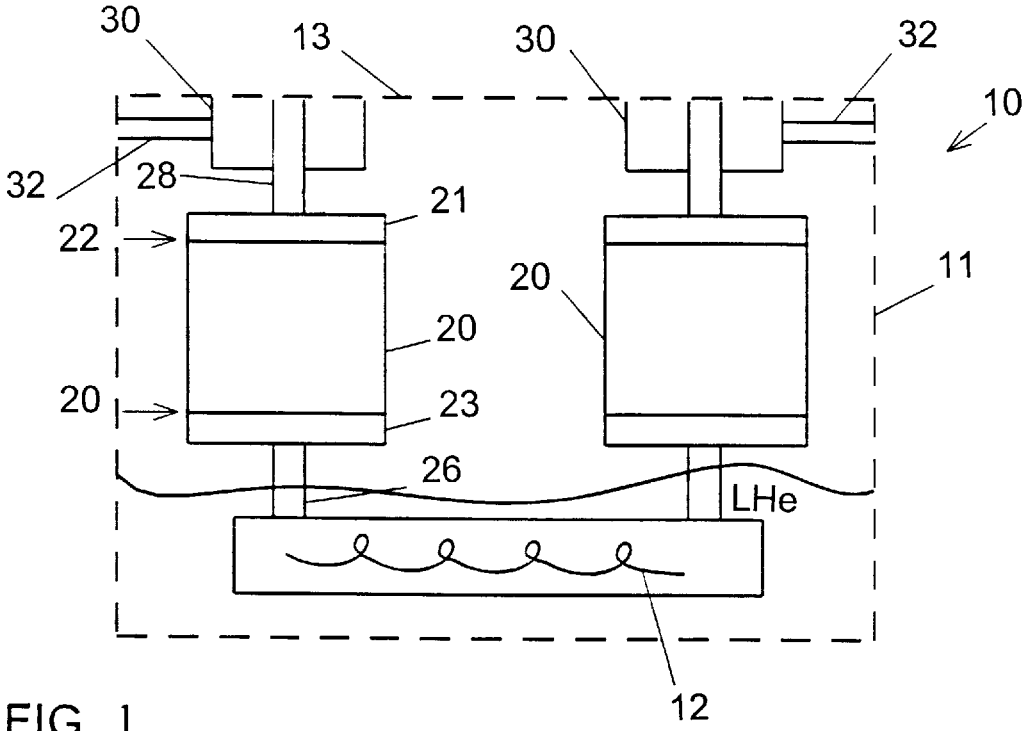
FIG. 1 is a schematic of a cryocooled magnet system in accordance with the invention.

Referring to FIG. 1, a cryogenic magnet system 10, such as can be used in a magnetic resonance imaging system and other similar applications, includes an enclosure 11, for example, a dewar cylinder held under a vacuum, containing a low or high temperature superconductor magnet 12 and high-temperature superconductor leads 20. Each HTS lead 20 has a warm end 22 attached to an upper copper plate 21 and a cold end 24 attached to a lower copper plate 23, and an upper stage, for example, a copper bus 28, which passes from a power source (not shown) through a wall 13 of enclosure 11 and attaches to upper copper plate 21. Lower copper plate 23 is attached to superconductor magnet 12 by, for example, a copper/low temperature superconductor (LTS) braid 26.

For a low temperature superconductor magnet, warm ends 22 are generally in the range of about 40 to 100 Kelvin, preferably, about 60 to 80 Kelvin, and cold ends 24 are generally in the range of about 4 to 20 Kelvin, most preferably, about 4 Kelvin. For a high temperature superconductor magnet, the warm ends 22 are also in the range of about 40 to 120 Kelvin, preferably, about 60 to 100 Kelvin, and cold ends 24 are generally in the range of about 4 to 77 Kelvin, preferably about 20 to 77 Kelvin, the chosen temperature depending upon the temperature requirements of the particular magnet.

Cold end 24 is maintained at cryogen temperature by, for example, liquid helium contained within enclosure 11. Warm end 22 is maintained at the desired temperature by, for example, circulating helium gas through an upper enclosure 30 which surrounds bus 28. Helium gas enters upper enclosure 30 through an inlet 32 connected to a refrigerated helium gas source (not shown). Alternatively, warm end 22 can be maintained at the desired temperature by a liquid nitrogen filled upper enclosure or by a cryocooler.

Figure 2:
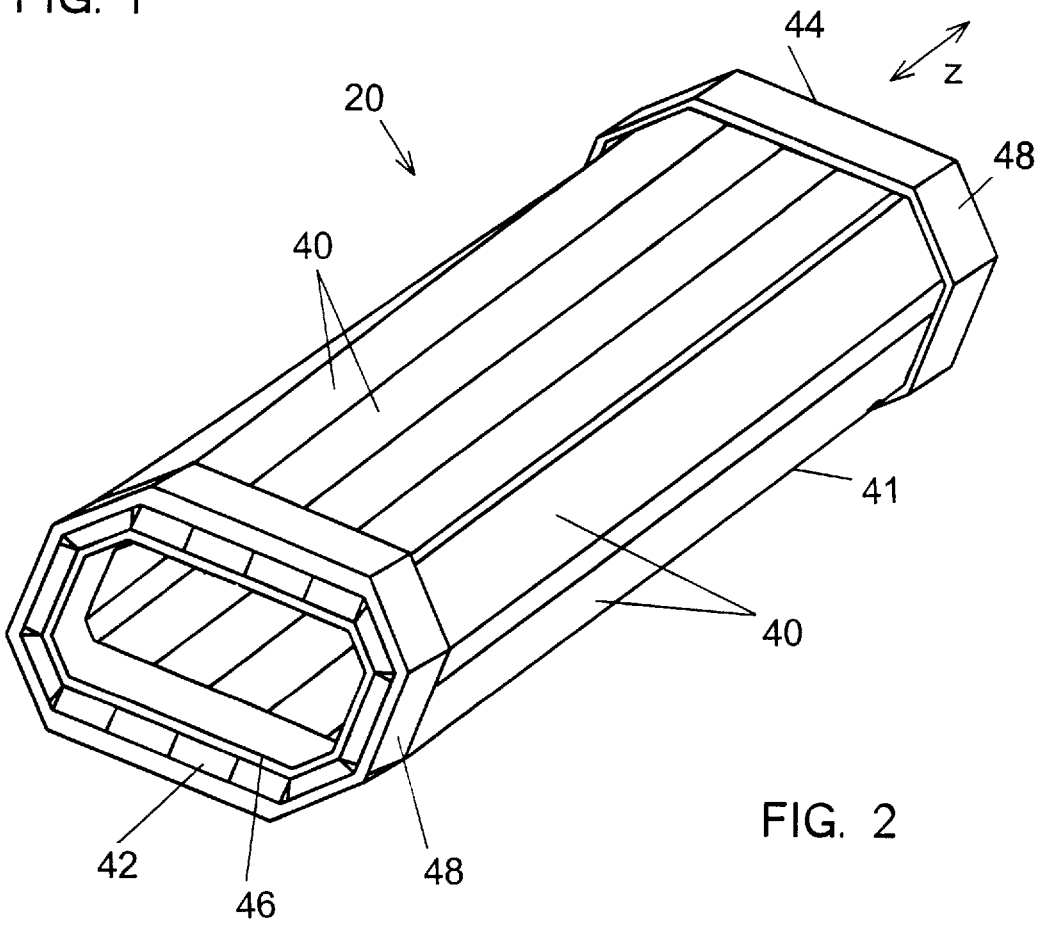
FIG. 2 is a diagrammatic representation of a high-temperature superconductor (HTS) lead according to the invention.

Referring to FIG. 2, high-temperature superconductor lead 20 is formed from a plurality of high-temperature superconductor lead elements 40, described further below, arranged, with their longitudinal axes oriented substantially parallel along an axis, z, of lead 20. The lead elements are arranged in an arcuate array defining a cylinder 41. The ends 42, 44 of each lead element 40 are mounted between an inner copper ring 46 and an outer copper ring 48.

Figure 3:
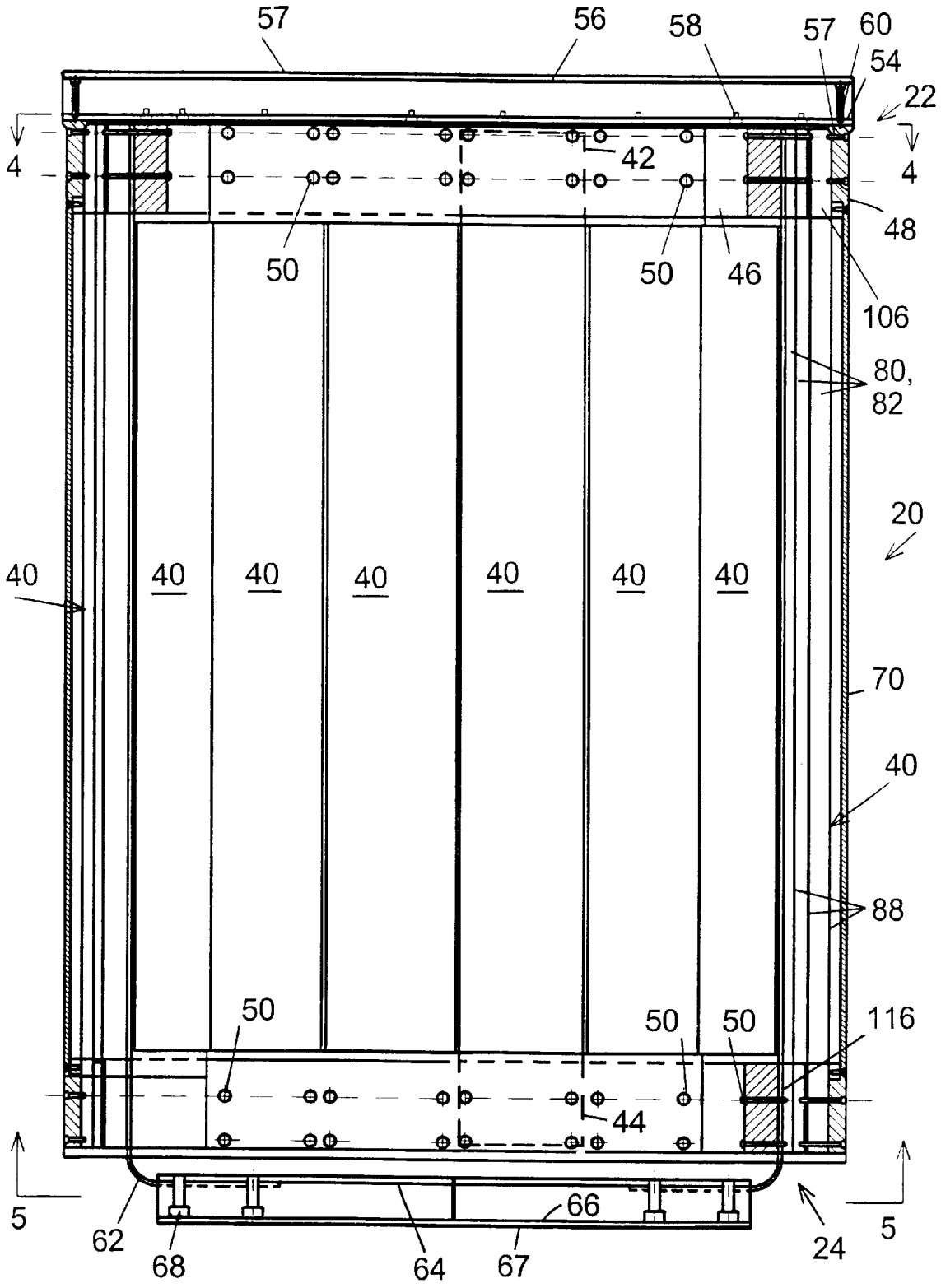
FIG. 3 is a side view in partial cross section of the HTS lead of FIG. 2.
Figure 4:
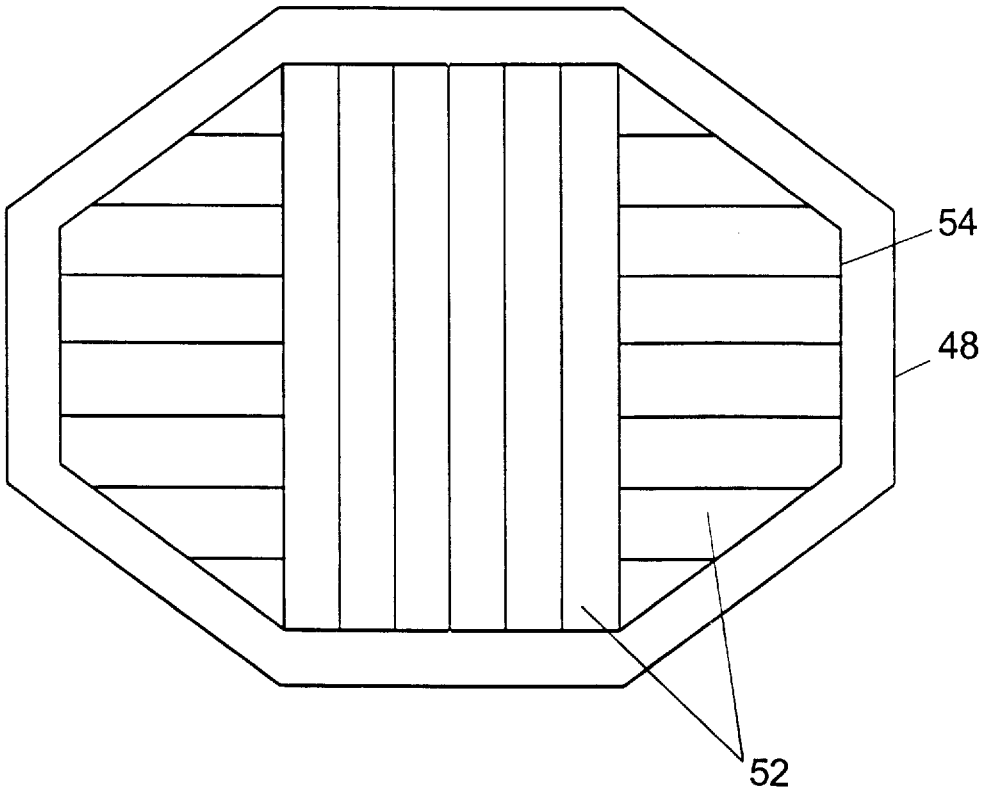
FIG. 4 is a top view of the HTS lead, taken along lines 4—4 of FIG. 3.

Referring also to FIGS. 3–4, ends 42, 44 of each lead element 40 are mounted to inner copper ring 46 by four bolts 50 and to outer copper ring 48 by four bolts 51, described further below. An outer casing 70 of insulating material encloses lead elements 40. At warm end 22, to maximize the contact area at the interface of copper bus 28 to lead 20, a series of HTS tapes 52 are mounted to a copper plate 54. Copper plate 54 is bolted to a copper top plate 56 with bolts 58; top plate 56 is soldered to outer ring 48 and bolted to outer ring 48 with bolts 60. Tapes 52 spread the current across top plate 56 to minimize the electrical impedance at the warm end. Copper top plate 56 is bolted to upper plate 21 (FIG. 1). An indium sheet 57 is placed between top plate 56 and upper plate 21 to reduce the contact resistance between the two plates.

Figure 5:
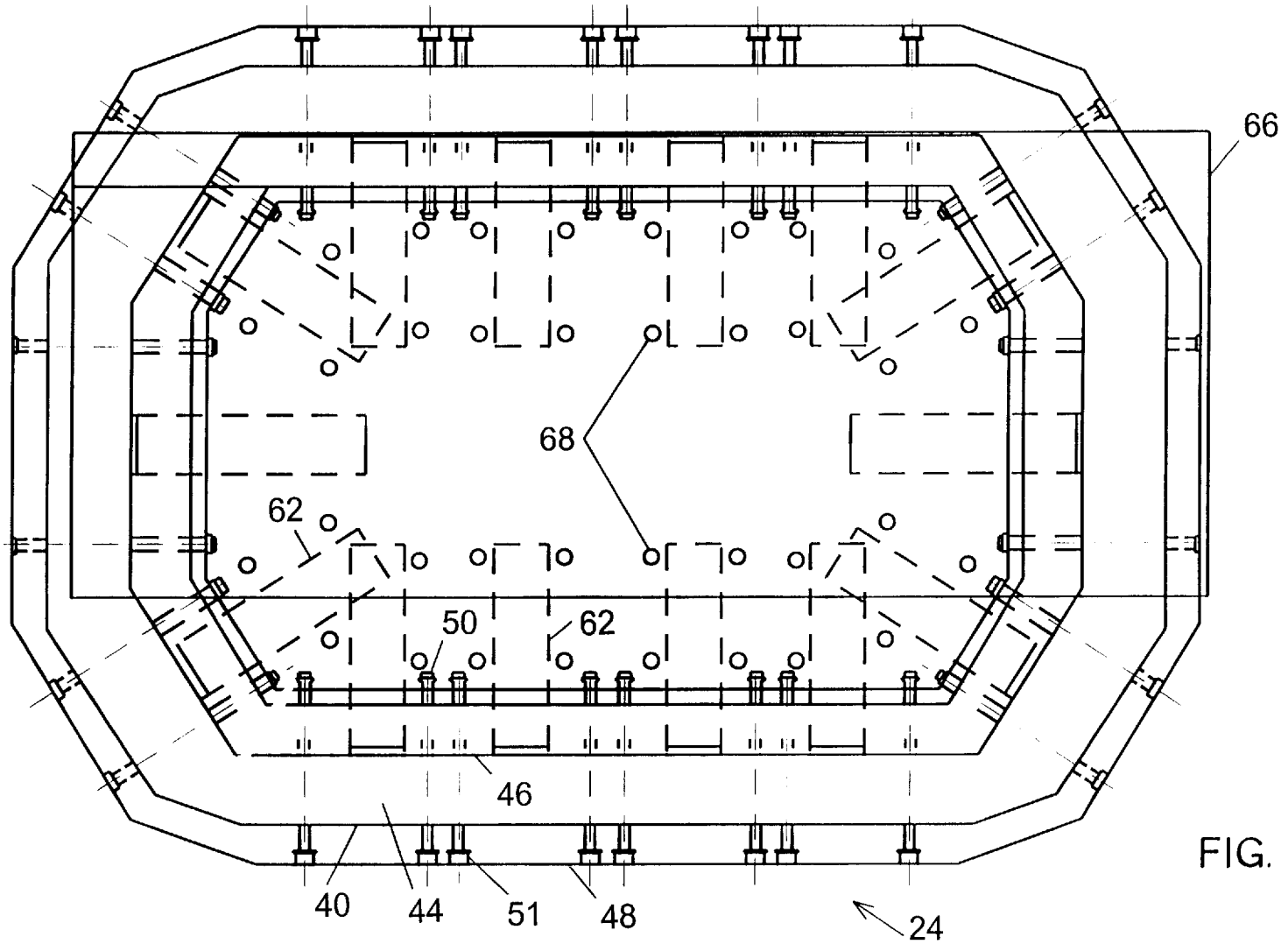
FIG. 5 is a bottom view of the HTS lead, taken along lines 5—5 of FIG. 3.

Referring also to FIG. 5, at cold end 24, to minimize losses at the interface of LTS bus 26 to lead 20, each lead element 40, at end 44, is electrically connected to an LTS braid 62, for example, an NbTi LTS, connected to inner ring 46. Braids 62 are sandwiched between a copper plate 64 (FIG. 3) and a copper bottom plate 66 connected with bolts 68. Plates 64, 66 hang by braids 62. Bolts 68 mechanically constrain braids 62 to plates 64, 66. Copper bottom plate 66 is bolted to lower plate 23 (FIG. 1). An indium sheet 67 is placed between bottom plate 66 and lower plate 23 to reduce the contact resistance between plates 66, 23.

Figure 6:
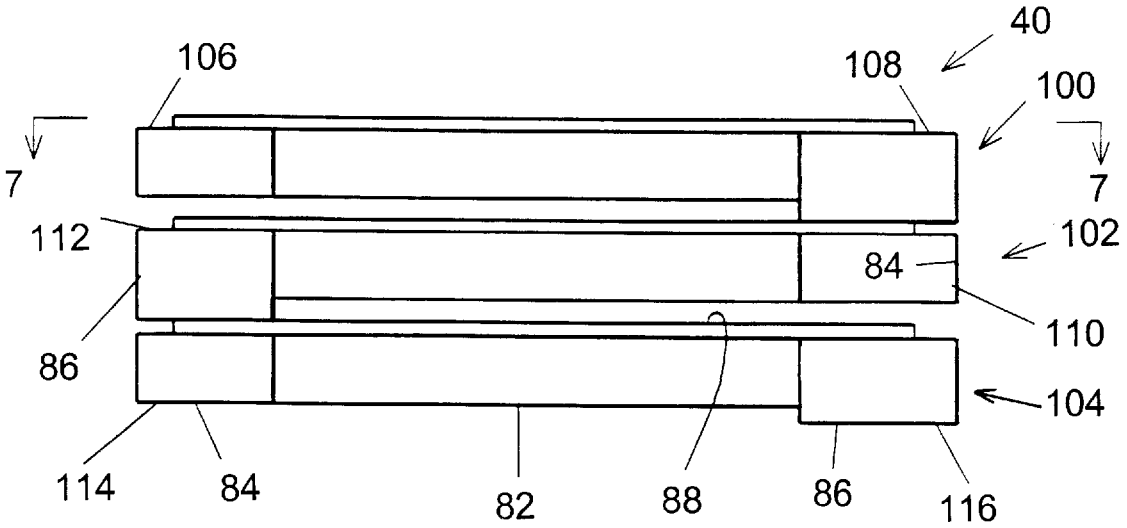
FIG. 6 is a side view of a lead element of the HTS lead of FIG. 2.

Referring to FIGS. 3 and 6, each HTS lead element 40 includes a series of HTS plates 80, preferably up to five plates, here three plates being shown, connected in a "zig-zag" configuration. Plates 80 may be connected end to end, or in overlapping relation, or formed by bending a continuous element by, for example, the well-known wind-and-react or react-and-wind processes. Each HTS plate 80 includes an elongated support 82, having pre-tinned copper end pieces 84, 86, to which a plurality of HTS tape stacks 88 are mounted. The "zig-zag" configuration effectively increases the thermal length of each lead element, thus decreases the heat leak of each lead element, reducing the cooling power needed to maintain the superconductor magnet at cryogenic temperature.

Figure 7:
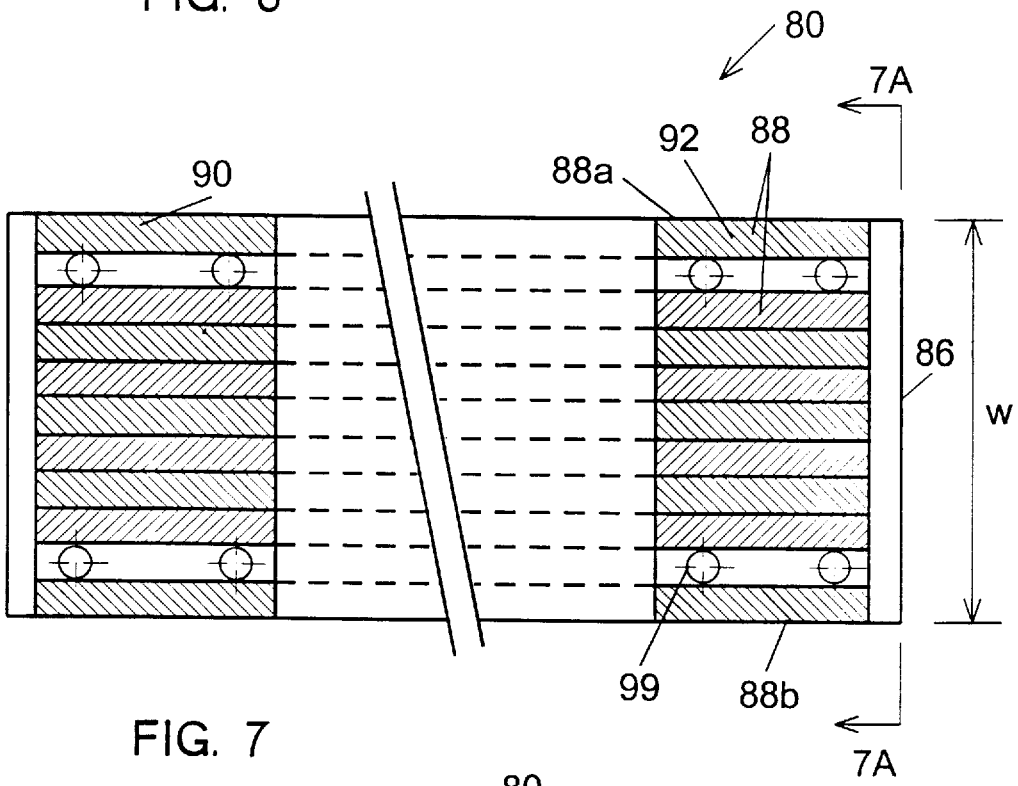
FIG. 7 is a top view of an HTS plate of the lead element, taken along lines 7—7 of FIG. 6.
Figure 7A:
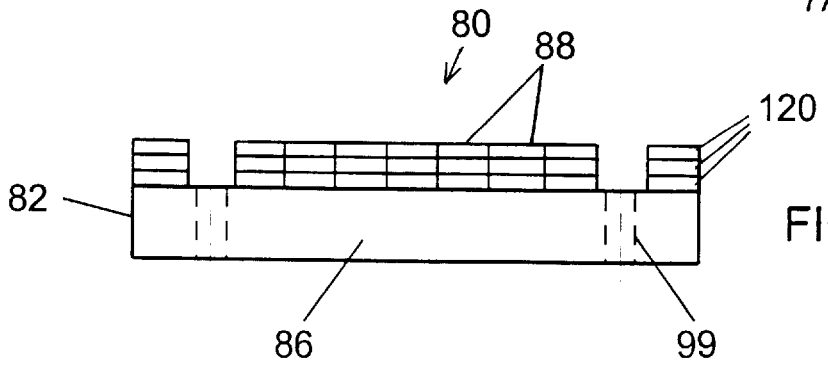
FIG. 7A is an end view of the HTS plate of FIG. 6.

Referring to FIGS. 7 and 7A, nine stacks 88 are arranged in a linear array across the width, W, of support 82. The linear array is formed by placing stacks 88 side-by-side on support 82 with ends 90, 92 of each stack being connected to a copper end piece 84, 86, respectively. Copper end piece 86 is thicker than copper end piece 84 to aid in the connection of adjacent plates, described below. The two end stacks 88*a*, 88*b* are spaced from their neighboring stacks to allow the placement of holes 99 for receiving mounting bolts 50.

As shown in FIG. 6, three HTS plates 100, 102, 104 are connected such that thick end piece 86 at a second end 108 of HTS plate 100 is electrically connected to thin end piece 84 at a first end 110 of plate 102, and thick end piece 86 at a second end 112 of plate 102 is electrically connected to thin end piece 84 at a first end 114 of plate 104. Referring also to FIG. 3, a first end 106 of plate 100 is held at the warm end temperature by mounting of first end 106 to warm end outer ring 48 by bolts 51, and a second end 116 of plate 104 is held at the cold end temperature by mounting of second end 116 to cold end inner ring 46 by bolts 50. At warm end 22, ends 112 and 114 are together mounted to inner ring 46 by bolts 50; at cold end 24, end 108 and 110 are together mounted to outer ring 48 by bolts 51. Ends 112 and 114 are vacuum insulated from the warm end outer ring 48, and ends 108 and 110 are vacuum insulated from the cold end inner ring 46. This results in end 112 of plate 102 and end 114 of plate 104 being colder than end 106 of plate 100, and end 108 of plate 100 and end 110 of plate 102 being warmer than end 116 of plate 104. Plates 100, 102, 104 are positioned non-collinear, preferably next to and parallel with each other. This "zig-zag" configuration increases the effective thermal length, and therefore decreases the heat leak, in each lead element 40.

Referring to FIG. 7A, each HTS stack 88 is formed from one or more superconducting tapes 120, three tapes being shown. Each tape 120 is typically about 10 mil thick by 170 mil wide and typically has a length in the range of about 10 cm to 1 m, but larger or smaller leads may also be built for specific applications. The tapes 120 are preferably stacked one on top of another and presintered to take advantage of the superconductor anisotropy. The number of tapes 120 in a stack 88 is determined by the amount of current carrying capacity desired and the number of stacks 88 in the linear array. Preferred embodiments include from 1 to 10 tapes 120 in a stack 88, more preferably from 2 to 5, the stacks arranged in a linear array of from 5 to 15 stacks 88.

To further reduce the heat leak in lead elements 40, it is particularly advantageous to decrease the number of tapes 120 in each stack 88 of the plates closer to the cold end connection at end 116 as compared to the plate at the warm end connection at end 106. For example, plate 100 has three tapes 120 per stack 88, plate 102 has two tapes 120 per stack 88, and plate 104 has one tape 120 per stack 88. The decrease in heat leak in this configuration occurs due to a decrease in thermal conductance with the use of fewer tapes. Fewer tapes 120 can be used toward the cold end because the current carrying capacity of the tapes increases as the tapes get colder.

Elongated support 82 is formed from, for example, a material that is a good electrical and thermal insulator such as fiberglass epoxy composite sheet material. G10 sheet material, manufactured as Garolite by Spaulding Composites, Rochester, N.H., is a suitable material. G10 sheet material can also be used for outer casing 70. G10 sheet material has a thermal conductivity in the warp and fill direction of 0.0035 W/cm-K and in the direction perpendicular to weave of 0.0027 W/cm-K, a breakdown voltage of 10 kV/mm, is not brittle at low temperature, can be machined with ordinary tools, and has a very low contribution to the heat load of the system. The total thermal contraction of G10 sheet material, being about 0.23% from 300K to 77K, is close to that of HTS tape 120. The G10 sheet material also has sufficient strength to provide for ease of handling of plate 80 (Young's modulus of G10 sheet material in the warp direction is 36 GPa, in the fill direction is 31 GPa, and in the direction perpendicular to weave is 23 GPa at cryogenic operating temperatures, e.g 77K).

Suitable materials for HTS tape 120 include, for example, superconducting ceramics of the oxide, sulfide, selenide, telluride, nitride, boron carbide or oxycarbonate types, in or on a supporting matrix. Superconducting oxides are preferred, for example, members of the rare earth (RBCO) family of oxide superconductors; the bismuth (BSCCO) family of oxide superconductors; the thallium (TBCCO) family of oxide superconductors or the mercury (HBCCO) family of oxide superconductors may be used. Silver and other noble metals are the preferred material for the matrix supporting or binding the superconducting ceramic. Alloys substantially comprising noble metals, including post-processed or oxide dispersion strengthened (ODS) silver may be used. By "noble" are meant metals which are substantially non-reactive with respect to superconducting ceramics and precursors and to the gasses required to form them under the expected conditions (temperature, pressure, atmosphere) of manufacture and use. Preferred noble metals include silver (Ag), gold (Au), platinum (Pt) and palladium (Pd). A Au/Ag alloy matrix in the range of 1 to 15 atomic percent, preferably 3 atomic percent, is the preferred matrix.

To assemble plate 80, tapes 120 are sintered together to form stacks 88, each stack 88 is bonded to support 82 by first soldering the ends of the composite to the pre-tinned copper end pieces 84, 86 at about 180° C., to form a low resistance joint. The portion of each stack 88 between the soldered ends is then coated with an epoxy adhesive.

Figure 8:
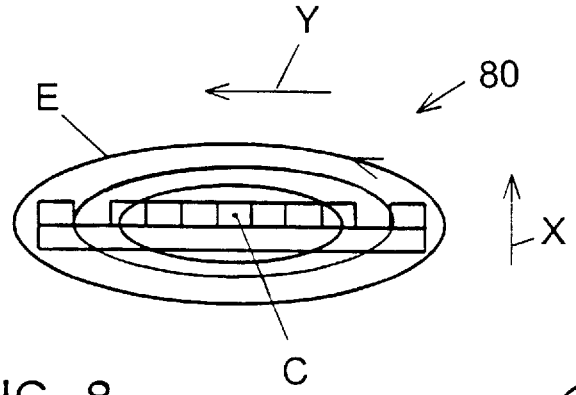
FIGS. 8, 8A, 8B and 8C are schematic views of the field orientations in the superconductor assemblies of FIGS. 7, 6, 2 and 1, respectively.

Referring to FIG. 8, which is an end view of a plate 80 similar to that of FIG. 7A, due to the anisotropic nature of the HTS superconductors, perpendicular fields, that is, fields in the x direction, significantly decrease the current carrying capability of tapes 120, and parallel fields, in the y direction, decrease their current carrying capability to a lesser extent. The self-fields generated in a single plate 80 are at zero gauss at center, C, and can be as high as 100–200 gauss, at the largest edge field, E.

Figure 8B:
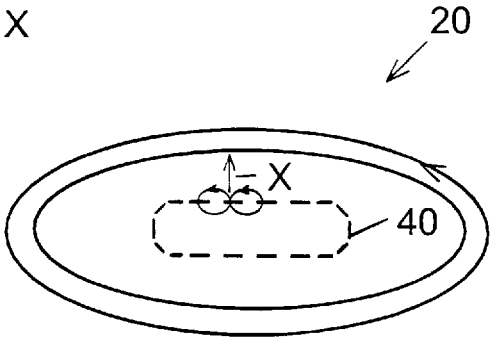
Figure 8A:
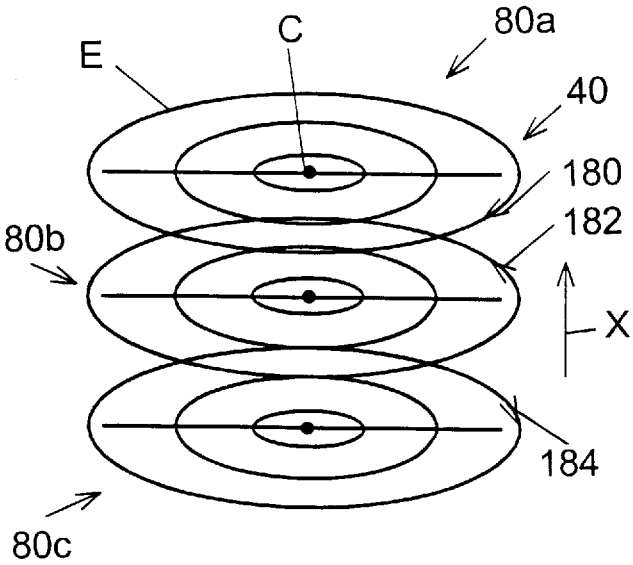

Referring to FIG. 8A, with three plates connected to form a "zig-zag" lead element 40, the self-fields of plates 80*a*, 80*b*, and 80*c* are along arrows 180, 182, 184, respectively. Since the self-fields along arrows 180 and 184 oppose the self-fields along arrow 182, the self-fields along the "bad", perpendicular direction, x, of the top and bottom two plates 80*a*, 80*c* advantageously cancel the "bad" self-fields of the middle plate 80*b*, the self-fields along the "good", parallel direction, y, of the top and bottom two plates 80*a*, 80*c* advantageously add to the self-fields of middle plate 80*b*, and the net self-field at each of the end plates 80*a*, 80*c* is slightly better than its own self-field.

Referring to FIG. 8B, with a plurality of lead elements 40 arranged side-by-side, cylindrically into a lead 20, substantially all "bad", x direction, fields cancel, further increasing the current carrying capability.

Figure 8C:
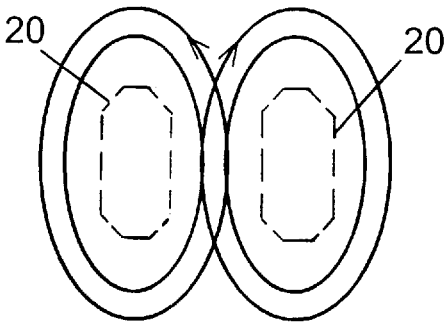

Referring to FIG. 8C, with two leads 20 placed in enclosure 11 (see FIG. 1), due to the oval shape of the leads, each lead's self-fields are aligned with the adjacent lead's self-fields such that a majority of the self-fields are parallel thus minimizing the addition of the "bad", x direction, self-fields.

Figure 9:
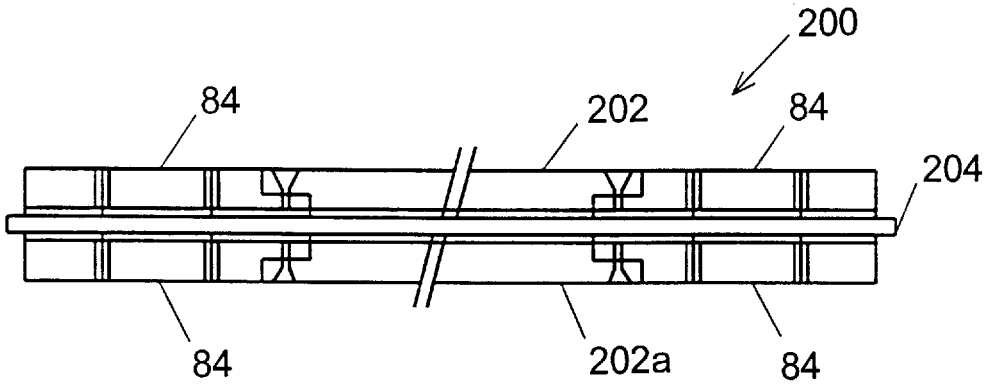
FIG. 9 is a side view of an alternative embodiment of a lead assembly.
Figure 10:
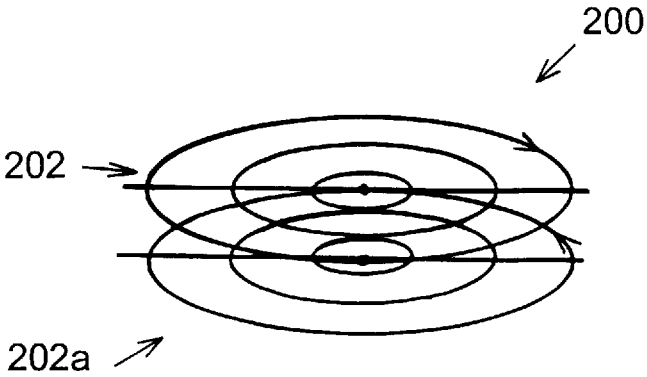
FIG. 10 is a schematic view of the field orientations in the lead assembly of FIG. 9.

Other embodiments are within the scope of the following claims. For example, referring to FIG. 9, a dual HTS lead 200 can be formed by arranging two HTS plates 202, 202*a* back-to-back, with an electrically insulating sheet 204, for example, a G10 sheet, placed therebetween. Plates 202, 202*a* are identical to plate 80, described above, except for including identical copper end pieces 84 at both ends. Dual HTS lead 200 can replace both leads 20, as shown in FIG. 1, with plate 202 carrying current to magnet 12 and plate 202*a* carrying current away from magnet 12. Referring to FIG. 10, this arrangement of plates 202, 202*a* has the particular advantage that to the extent the field lines fully overlap, the field lines cancel in the "bad", x, direction significantly improving field performance.

Figure 11:
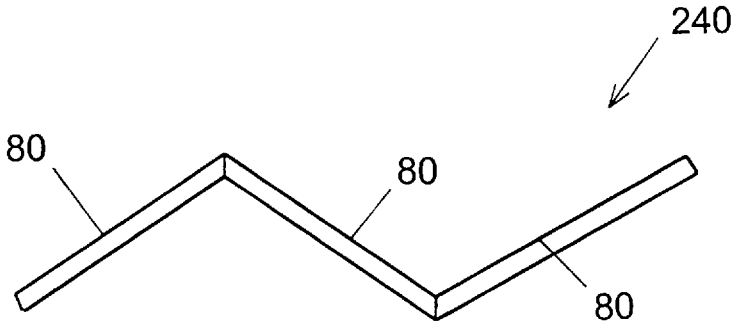
FIG. 11 is a diagrammatic representation of an alternative embodiment of a lead assembly.
Figure 12:
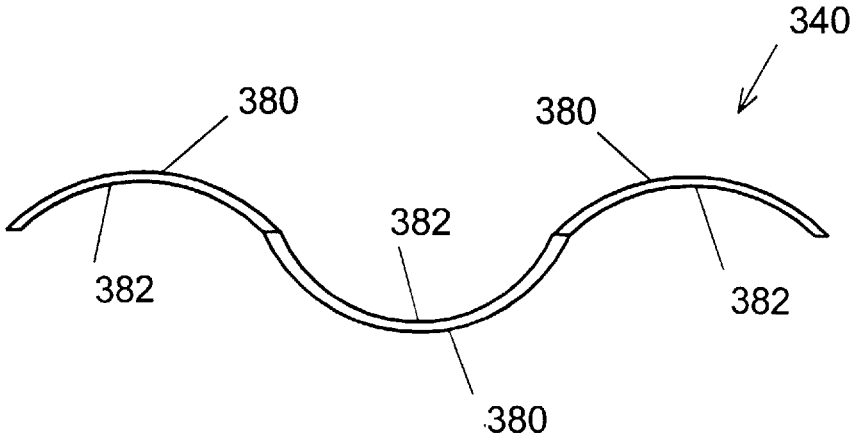
FIG. 12 is a diagrammatic representation of an additional alternative embodiment of a lead assembly.

Other non-collinear arrangements of an HTS lead element can be employed to increase the thermal length, and therefore decrease the heat leak, in each HTS lead element. For example, referring to FIG. 11, an HTS lead element 240 can include plates 80 in a "Z" configuration. Referring to FIG. 12, an HTS lead element 340 includes plates 380 having one or more curved supports 382, three being shown.

While this invention has been described with reference to a lead intended for use in a substantial temperature gradient, it is also applicable to a current lead, such as a busbar, intended for use with end temperatures substantially the same.

Additions, subtractions and other modifications of the illustrated embodiments of the invention will be apparent to those practiced in the art and are within the scope of the following claim.

What is claimed is:

1. A high-temperature superconductor lead element, comprising:

a first length of high-temperature superconductor having a proximal end and a distal end, said proximal end being configured for thermal connection to a warm thermal element, a second length of high-temperature superconductor having a proximal end and a distal end, said second length proximal end being electrically connected to said first length distal end and said second length distal end being configured for thermal connection to a cold thermal element, said second length of high-temperature superconductor being non-collinear with said first length of high-temperature superconductor.

2. The high-temperature superconductor lead element of claim 1 wherein said second length is positioned next to and parallel with said first length, said first length proximal end opposing said second length distal end and said first length distal end opposing said second length proximal end.

3. The high-temperature superconductor lead element of claim 2, wherein "bad" self-fields of said first length oppose "bad" self-fields of said second length.

4. The high-temperature superconductor lead element of claim 2, wherein "good" self-fields of said first length add to "good" self-fields of said second length.

5. The high-temperature superconductor lead element of claim 1 further comprising a third length of high-temperature superconductor, said third length being positioned between said first and second lengths with a first end electrically connected to said first distal end and a second end electrically connected to said second proximal end such that said first and second lengths are electrically connected through said third length, said third length being non-collinear with said first length and non-collinear with said second length.

6. The high-temperature superconductor lead element of claim 5 wherein said third length is positioned next to and parallel with said first length and said second length is positioned next to and parallel with said third length, said first length proximal end opposing said third length second end, said first length distal end opposing said third length first end, said second length proximal end opposing said third length second end, and said second length distal end opposing said third length first end.

7. The high-temperature superconductor lead element of claim 6, wherein "bad" self-fields of said first length and said second length oppose "bad" self-fields of said third length.

8. The high-temperature superconductor lead element of claim 5 wherein each of said first, second, and third lengths comprises a high-temperature superconductor plate having an electrically insulative support, and a plurality of high-temperature superconductor tapes mounted, in a linear array, on said support.

9. The high-temperature superconductor lead element of claim 8 wherein said superconductor tapes are arranged in a plurality of stacks of one or more tapes per stack.

10. The high-temperature superconductor lead element of claim 9 wherein said first length has more tapes per stack than said second length.

11. The high-temperature superconductor lead element of claim 10 wherein said third length has more tapes per stack than said second length and less tapes per stack than said first length.

12. The high-temperature superconductor lead element of claim 1 wherein said first and second lengths include high-temperature superconductor tapes, said first length having more tapes than said second length.

13. The high-temperature superconductor lead element of claim 12 wherein said first and second lengths comprise stacks of high-temperature superconductor tapes, said first length having more tapes per stack than said second length.

14. A high-temperature superconductor lead element comprising:

a plurality of lengths of high-temperature superconductor, said lengths being electrically connected in a non-collinear configuration, a proximal end of a first of said plurality of lengths being configured for thermal connection to a warm thermal element, and a distal end of a last of said plurality of lengths being configured for thermal connection to a cold thermal element.

15. The high-temperature superconductor lead element of claim 14 wherein said lengths include a high-temperature superconductor tape, a cross-sectional area of said tape in each length remains the same, or decreases from said first length to said last length, with said last length having a smaller cross-sectional area than said first length.

16. A high-temperature superconductor lead element, comprising:

a first length of high-temperature superconductor having a proximal end and a distal end, said proximal end being configured for thermal connection to a warm thermal element, a second length of high-temperature superconductor having a proximal end and a distal end, said second length proximal end being electrically connected to said first length distal end and said second length distal end being configured for thermal connection to a cold thermal element, said first and second lengths including a high-temperature superconductor tape, said first length tape having a greater cross-sectional area than said second length tape.

17. The high-temperature superconductor lead element of claim 16 wherein said first and second lengths comprise a plurality of high-temperature superconductor tapes, said first length having more tapes than said second length.

18. A high-temperature superconductor lead, comprising:

a plurality of high-temperature superconductor plates, each high-temperature superconductor plate defining a longitudinal axis, said high-temperature plates being arranged with their longitudinal axis parallel to form a cylinder, each high-temperature superconductor plate including an electrically insulative support, and a plurality of high-temperature superconductor tapes mounted side-by-side in a linear array on said support.

19. The high-temperature superconductor lead of claim 18, wherein said plates are arranged such that "bad" self-fields are substantially cancelled.

20. A dual high-temperature superconductor lead, comprising:

two high-temperature superconductor plates, each high-temperature superconductor plate including an electrically insulative support, and a plurality of high-temperature superconductor tapes mounted side-by-side in a linear array on said support, and an insulating sheet placed between said high-temperature superconductor plates.

21. A high-temperature superconductor lead element, comprising:

a high-temperature superconductor having a first end and a second end, said first end including an end piece configured for thermal connection to a warm thermal element and said second end including an end piece configured for thermal connection to a cold thermal element, said high-temperature superconductor being configured to take a non-linear route from said first end piece to said second end piece.

* * * * *